US008754837B2

(12) United States Patent
Yamato et al.

(10) Patent No.: US 8,754,837 B2
(45) Date of Patent: Jun. 17, 2014

(54) LIQUID CRYSTAL DRIVING CIRCUIT AND LIQUID CRYSTAL DISPLAY DEVICE

(75) Inventors: Asahi Yamato, Osaka (JP); Masaki Uehata, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 232 days.

(21) Appl. No.: 13/382,172

(22) PCT Filed: May 21, 2010

(86) PCT No.: PCT/JP2010/003444
§ 371 (c)(1), (2), (4) Date: Jan. 4, 2012

(87) PCT Pub. No.: WO2011/004538
PCT Pub. Date: Jan. 13, 2011

(65) Prior Publication Data

US 2012/0105514 A1 May 3, 2012

(30) Foreign Application Priority Data

Jul. 10, 2009 (JP) ..... 2009-163743

(51) Int. Cl.
*G09G 3/36* (2006.01)
*G09G 5/10* (2006.01)

(52) U.S. Cl.
USPC ..... 345/96; 345/209

(58) Field of Classification Search
None
See application file for complete search history.

(56) References Cited

U.S. PATENT DOCUMENTS

| | | | | |
|---|---|---|---|---|
| 5,847,688 | A | 12/1998 | Ohi et al. | |
| 6,466,225 | B1 | 10/2002 | Larkin et al. | |
| 2002/0149598 | A1* | 10/2002 | Greier et al. | 345/589 |
| 2004/0239698 | A1* | 12/2004 | Kamada et al. | 345/714 |
| 2005/0093806 | A1 | 5/2005 | Hosotani | |
| 2005/0122441 | A1 | 6/2005 | Shimoshikiryoh | |
| 2006/0221029 | A1* | 10/2006 | Hsu et al. | 345/88 |
| 2006/0290626 | A1 | 12/2006 | Arimoto et al. | |
| 2007/0013633 | A1* | 1/2007 | Kamada et al. | 345/98 |
| 2008/0129762 | A1* | 6/2008 | Shiomi | 345/690 |
| 2008/0158203 | A1* | 7/2008 | Irie et al. | 345/204 |

FOREIGN PATENT DOCUMENTS

| | | | |
|---|---|---|---|
| CN | 1614677 | | 5/2005 |
| JP | 07121144 | A | 5/1995 |
| JP | 2000029442 | A | 1/2000 |
| JP | 2003255306 | A | 9/2003 |
| JP | 2005189804 | A | 7/2005 |
| JP | 2006184516 | A | 7/2006 |
| WO | WO-2005038766 | A1 | 4/2005 |

OTHER PUBLICATIONS

International Search Report and Written Opinion of Searching Authority.

* cited by examiner

*Primary Examiner* — Sumati Lefkowitz
*Assistant Examiner* — Josemarie G Acha, III
(74) *Attorney, Agent, or Firm* — Harness, Dickey & Pierce

(57) ABSTRACT

A liquid crystal driving circuit is disclosed which carries out time-division driving with respect to each pixel constituting a liquid crystal display panel by causing a bright and dark frame period and a positive and negative frame period to be different from each other, the bright and dark frame period being a period of brightness and darkness of luminance at which to drive the each pixel, the positive and negative frame period being a period of polarities of a voltage to be applied to liquid crystal of the each pixel.

7 Claims, 12 Drawing Sheets

LIQUID CRYSTAL DRIVING CIRCUIT AND LIQUID CRYSTAL DISPLAY DEVICE

TECHNICAL FIELD

The present invention relates to a liquid crystal driving circuit which carries out time-division driving with respect to an active matrix liquid crystal display panel and a liquid crystal display device including the liquid crystal driving circuit.

BACKGROUND ART

A liquid crystal display device is a plane display device which has excellent characteristics of being high-definition, thin, and light and realizing low power consumption. The market for the liquid crystal display device has recently been expanded rapidly along with improvement in display performance, production capacity, and price competitiveness over other display devices.

A conventionally common twisted nematic mode (TN mode) liquid crystal display device is subjected to an alignment treatment such that major axes of respective liquid crystal molecules having a positive dielectric anisotropy are aligned substantially parallel to a substrate surface so that the major axes are twisted by substantially 90° between upper and lower substrates along a thickness direction of a liquid crystal layer. Application of a voltage to the liquid crystal layer causes the liquid crystal molecules to rise parallel to an electric field, so that no twist alignment exists. The TN mode liquid crystal display device uses a change in optical rotation in response to a change in alignment of the liquid crystal molecules by voltage application, so as to control an amount of transmitted light.

The TN mode liquid crystal display device is excellent in productivity due to its wide production margin. In contrast, the TN mode liquid crystal display device has a problem about display performance, especially a viewing angle characteristic. Specifically, the TN mode liquid crystal display device has a problem such that a display contrast ratio is dramatically reduced when a display plane of the TN mode liquid crystal display device is obliquely observed and a luminance difference between gray scales is considerably indistinct when an image is obliquely observed such that a plurality of gray scales from black to white are distinctly observed when the image is observed from the front. The TN mode liquid crystal display device also has a problem about a phenomenon (a so-called gray scale reversal phenomenon) such that a gray scale characteristic of a display is reversed and a part which is darker when observed from the front is brighter when obliquely observed.

A liquid crystal display device which has been developed by improving a viewing angle characteristic of such a TN mode liquid crystal display device is exemplified by an IPS mode (in-plane switching mode) liquid crystal display device, an MVA mode (multi-domain vertically-aligned mode) liquid crystal display device, and a CPA (Continuous Pinwheel Alignment) mode liquid crystal display device.

Each of these new mode (broad viewing angle mode) liquid crystal display devices solves the specific problems described above about a viewing angle characteristic. Namely, there occurs no problem such that (i) a display contrast ratio is dramatically reduced when a display plane is obliquely observed and (ii) a display gray scale is reversed.

However, as a display quality of a liquid crystal display device improves, a new problem about a viewing angle characteristic is growing more evident. The new problem is a phenomenon such that a γ characteristic is different between when a display plane is observed from the front and when the display plane is obliquely observed, i.e., a problem of a viewing angle dependence of the γ characteristic (e.g., excess brightness). Note here that the γ characteristic is a gray scale dependence of a display luminance. The phenomenon such that the γ characteristic is different between when the display plane is observed from the front and when the display plane is obliquely observed causes a gray scale display state to differ depending on an observation direction. Therefore, such a phenomenon causes a problem especially in a case where an image such as a photograph is displayed or in a case where a TV broadcast or the like is displayed.

The problem of the viewing angle dependence of the γ characteristic is more noticeable in the MVA mode and the CPA mode than in the IPS mode. In contrast, it is more difficult in the IPS mode than in the MVA mode and the CPA mode to produce, with high productivity, a panel which has a high contrast ratio when observed from the front. In view of these points, especially the MVA mode liquid crystal display device and the CPA mode liquid crystal display device are desired to improve in viewing angle dependence of the γ characteristic.

Patent Literature 1 discloses a liquid crystal display device which includes an image processing section in which a high luminance frame and a low luminance frame are combined. In the high luminance frame, each pixel is driven at a higher luminance than a specified luminance corresponding to a gray scale value of input image data. In the low luminance frame, the each pixel is driven at a lower luminance than the specified luminance. In order to obtain a luminance which is substantially equal to the specified luminance, the image processing section determines a luminance (a bright luminance) at which the each pixel is driven in the high luminance frame and a luminance (a dark luminance) at which the each pixel is driven in the low luminance frame, and a ratio of the high luminance frame to the low luminance frame. According to this liquid crystal display device, which carries out so-called time-division driving with respect to the each pixel, an average value of a brighter bright luminance and a darker dark luminance is displayed as an intermediate luminance. This reduces occurrence of excess brightness due to the intermediate luminance and consequently can improve the viewing angle dependence of the γ characteristic.

CITATION LIST

Patent Literature

Patent Literature 1

Japanese Patent Application Publication, Tokukai, No. 2006-184516 A (Publication Date: Jul. 13, 2006)

SUMMARY OF INVENTION

Technical Problem

The technique disclosed in Patent Literature 1 causes a problem such that a liquid crystal application voltage applied to the each pixel has a polarity which is either too positive or too negative. This is because a bright and dark frame period of luminance and a positive and negative frame period are identical (synchronize). Specifically, assume that a voltage of the positive polarity is constantly applied to liquid crystal of the each pixel while the each pixel is being driven at the bright luminance. In this case, a voltage of the negative polarity is constantly applied to the liquid crystal of the each pixel while the each pixel is being driven at the dark luminance. As a result, the voltage which is applied to the liquid crystal and has the positive polarity constantly has a larger amplitude (absolute value) than the voltage which is applied to the liquid crystal and has the negative polarity. Consequently, a temporal average value of an amplitude of the liquid crystal application voltage is too far to the positive polarity side.

In contrast, assume that a voltage of the negative polarity is constantly applied to the liquid crystal of the each pixel while the each pixel is being driven at the bright luminance. In this case, a voltage of the positive polarity is constantly applied to the liquid crystal of the each pixel while the each pixel is being driven at the dark luminance. As a result, the voltage which is applied to the liquid crystal and has the negative polarity constantly has a larger amplitude (absolute value) than the voltage which is applied to the liquid crystal and has the positive polarity. Consequently, a temporal average value of an amplitude of the liquid crystal application voltage is too far to the negative polarity side.

In any case, it follows that a voltage whose polarity is either too positive or too negative is constantly applied to the liquid crystal of the each pixel. This causes a problem in terms of display such that (i) an image is displayed with lower reliability and (ii) an image is displayed with stripes.

The present invention has been made in view of the problems, and an object of the present invention is to provide a liquid crystal driving circuit which is capable of (i) improving a viewing angle by carrying out time-division driving with respect to each pixel, (ii) preventing an image display with lower reliability, and reducing stripes in an image to be displayed, and a liquid crystal display device including the liquid crystal driving circuit.

Solution to Problem

In order to attain the object, a liquid crystal driving circuit in accordance with the present invention which carries out time-division driving with respect to each pixel constituting an active matrix liquid crystal display panel, the liquid crystal driving circuit includes: brightness or darkness determining means for determining at which of a bright luminance and a dark luminance to drive the each pixel in each frame, the bright luminance being brighter than a specified luminance which corresponds to inputted gray scale data, the dark luminance being darker than the specified luminance; polarity determining means for determining which of a voltage of a positive polarity and a voltage of a negative polarity to apply to liquid crystal of the each pixel in the each frame; and driving means for driving the each pixel by causing a bright and dark frame period and a positive and negative frame period to be different from each other, the bright and dark frame period being a period of brightness and darkness of luminance at which to drive the each pixel, the positive and negative frame period being a period of polarities of the voltage to be applied to the liquid crystal of the each pixel.

According to the configuration, the liquid crystal driving circuit carries out time-division driving with respect to the active matrix liquid crystal display panel. Specifically, regarding a consecutive plurality of frame periods as a unit cycle, the liquid crystal driving circuit determines at which of a bright luminance and a dark luminance to drive the each pixel in each frame of the unit cycle, the bright luminance being brighter than a specified luminance which corresponds to inputted gray scale data, the dark luminance being darker than the specified luminance. Thus, the each pixel is driven at the bright luminance in a frame, whereas the each pixel is driven at the dark luminance in another frame. Accordingly, in a case where the bright luminance and the dark luminance are temporarily averaged, an original luminance (a target luminance) corresponding to the gray scale data is visible to human beings.

In a case where time-division driving is carried out as described above, it is possible to prevent occurrence of excess brightness in an image and consequently to improve a viewing angle.

The liquid crystal driving circuit further employs a driving method in which the polarities of the voltage to be applied to the liquid crystal of the each pixel are reversed every any number of frames. Note here that the liquid crystal driving circuit drives the each pixel by causing a bright and dark frame period and a positive and negative frame period to be different from each other, the bright and dark frame period being a period of brightness and darkness of luminance at which to drive the each pixel, the positive and negative frame period being a period of polarities of the voltage to be applied to the liquid crystal of the each pixel. For example, a ratio of the bright and dark frame period to the positive and negative frame period is 1 to 2. This prevents the bright and dark frame period and the positive and negative frame period from synchronizing with each other. Accordingly, in this case, it is possible to cause a liquid crystal application voltage to be less likely to have a polarity which is either too positive or too negative than in a case where the bright and dark frame period and the positive and negative frame period synchronize with each other.

As described earlier, the liquid crystal driving circuit is capable of (i) improving a viewing, angle by carrying out time-division driving with respect to each pixel, (ii) preventing an image display with lower reliability, and (iii) reducing stripes in an image to be displayed.

For a fuller understanding of the nature and advantages of the invention, reference should be made to the ensuing detailed description taken in conjunction with the accompanying drawings.

Advantageous Effects of Invention

As described earlier, the liquid crystal driving circuit in accordance with the present invention is capable of (i) improving a viewing angle by carrying out time-division driving with respect to each pixel, (ii) preventing an image display with lower reliability, and (iii) reducing stripes in an image to be displayed.

BRIEF DESCRIPTION OF DRAWINGS

FIG. 1 illustrates an arrangement of a relevant part of a liquid crystal display device of the present embodiment.

FIG. 2 illustrates a structure of a relevant part of a liquid crystal display panel.

FIG. 3 illustrates (i) a waveform of a liquid crystal application voltage and (ii) transitions between brightness and darkness of luminance and between positive and negative polarities in a case where time-division driving is carried out with respect to each pixel in a ratio of a bright and dark frame period to a positive and negative frame period of 1 to 2.

FIG. 4 illustrates (i) a waveform of a liquid crystal application voltage and (ii) transitions between brightness and darkness of luminance and between positive and negative polarities in a case where time-division driving is carried out with respect to each pixel in a ratio of the bright and dark frame period to a positive and negative frame period of 1 to 2.

FIG. 5 illustrates (i) a waveform of a liquid crystal application voltage and (ii) transitions between brightness and darkness of luminance and between positive and negative polarities in a case where time-division driving is carried out with respect to each pixel in a ratio of the bright and dark frame period to the positive and negative frame period of 2 to 1.

FIG. 6 illustrates transitions between brightness and darkness and between positive and negative polarities of four pixels contained in a unit when time-division driving and area-division driving are carried out with respect to the unit and line reversal driving is carried out with respect to the liquid crystal display panel.

Figure 7:
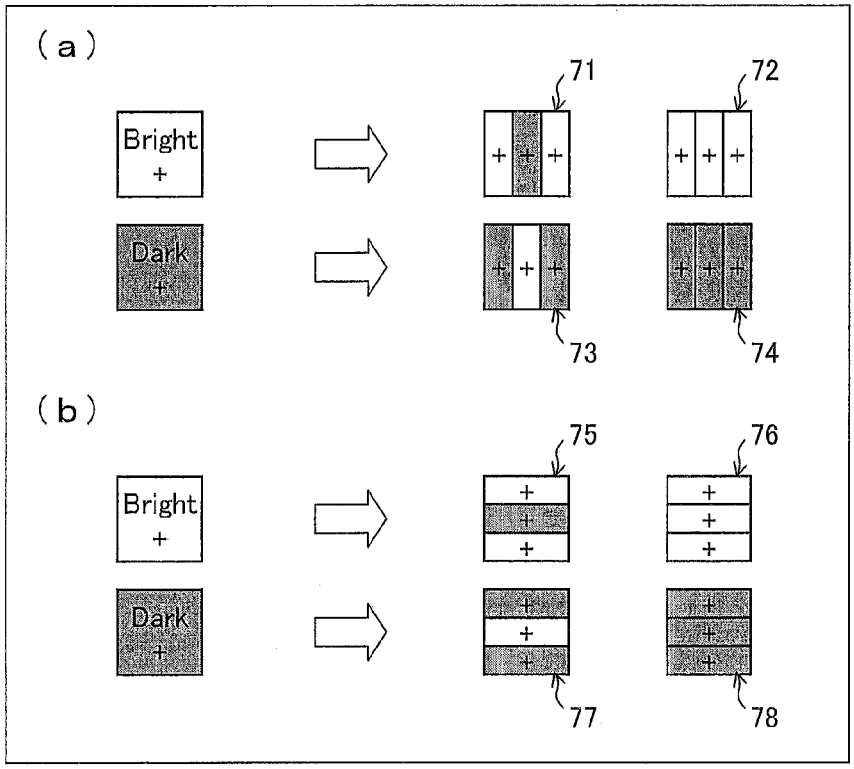
FIG. 7

(a) of FIG. 7 shows an example of a combination of brightness and darkness of a subpixel which combination determines brightness and darkness of each pixel constituted by three subpixels which are arranged in a vertical stripe pattern. (b) of FIG. 7 shows an example of a combination of brightness and darkness of a subpixel which combination determines brightness and darkness of each pixel constituted by three subpixels which are arranged in a transverse stripe pattern.

FIG. 8

Figure 8:
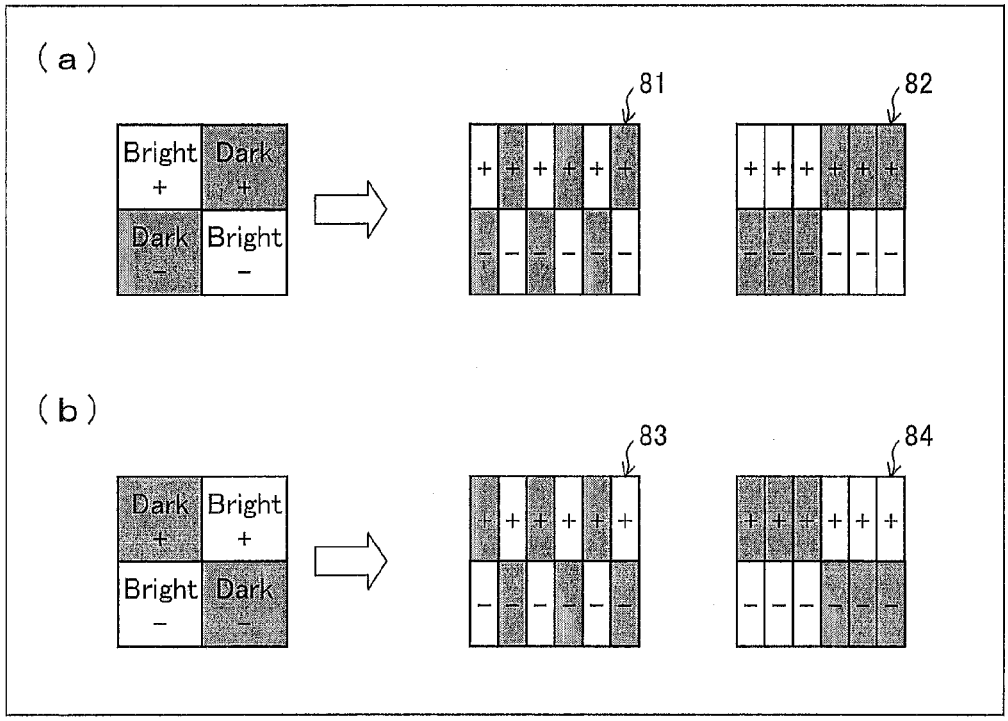

(a) of FIG. 8 illustrates a state of brightness and darkness and polarities of subpixels when time-division driving and area-division driving are carried out in a first frame with respect to a unit containing four pixels each constituted by three subpixels. (b) of FIG. 8 illustrates a state of brightness and darkness and polarities of subpixels when time-division driving and area-division driving are carried out in a second frame following the first frame with respect to a unit containing four pixels each constituted by three subpixels.

FIG. 9

Figure 9:
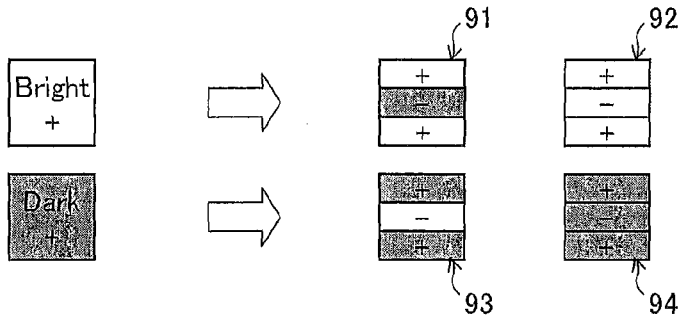

FIG. 9 illustrates a state of brightness and darkness and polarities of liquid crystal subpixels when each pixel is constituted by three subpixels which are arranged in a transverse stripe pattern and polarities of a liquid crystal application voltage are reversed for each subpixel in an identical frame.

FIG. 10

Figure 10:
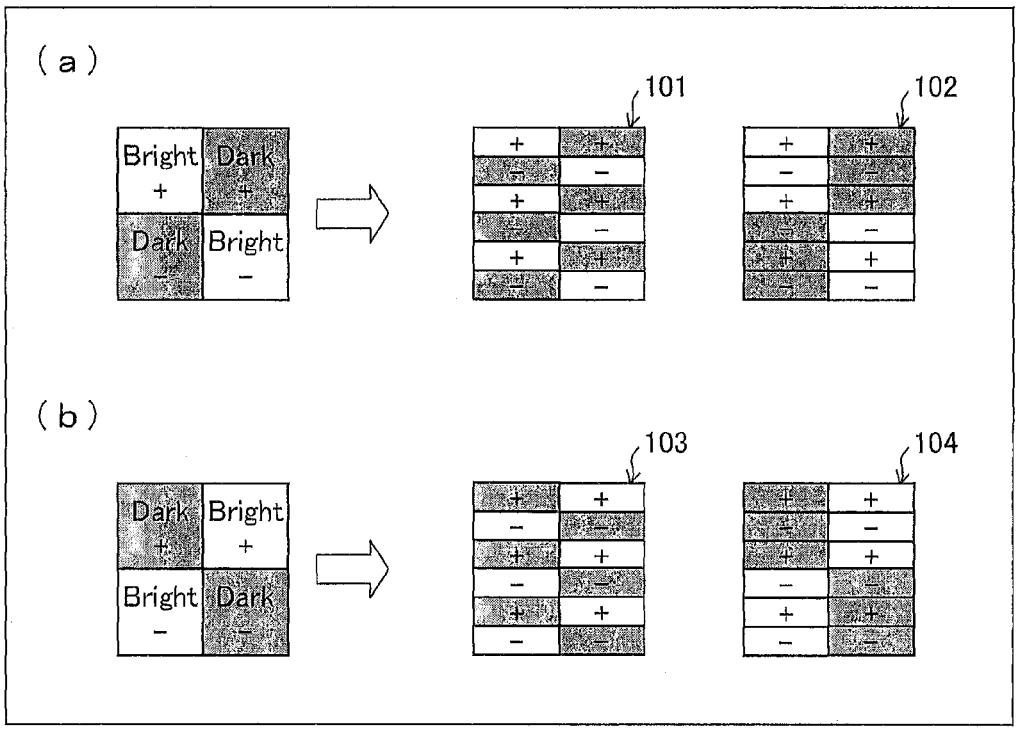

(a) of FIG. 10 illustrates a state of brightness and darkness and polarities of subpixels when time-division driving and area-division driving are carried out in a first frame with respect to a unit containing four pixels each constituted by three subpixels and polarities of a liquid crystal application voltage applied to each of the three subpixels are reversed in the first frame. (b) of FIG. 10 illustrates a state of brightness and darkness and polarities of subpixels when time-division driving and area-division driving are carried out in a second frame following the first frame with respect to a unit containing four pixels each constituted by three subpixels and polarities of a liquid crystal application voltage applied to each of the three subpixels are reversed in the second frame.

FIG. 11

Figure 11:
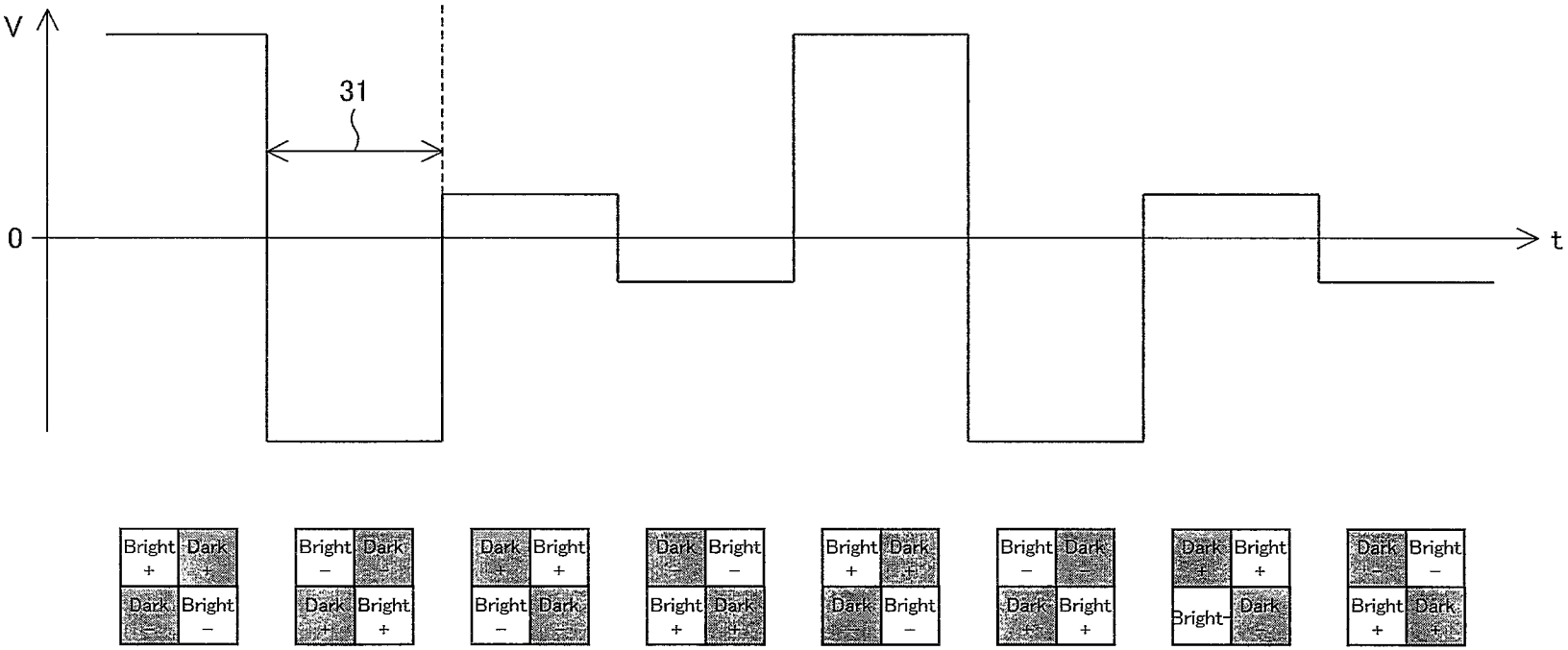

FIG. 11 illustrates transitions between brightness and darkness and between positive and negative polarities of four pixels contained in a unit when time-division driving and area-division driving are carried out with respect to the unit and line reversal driving is carried out with respect to the liquid crystal display panel.

FIG. 12

Figure 12:
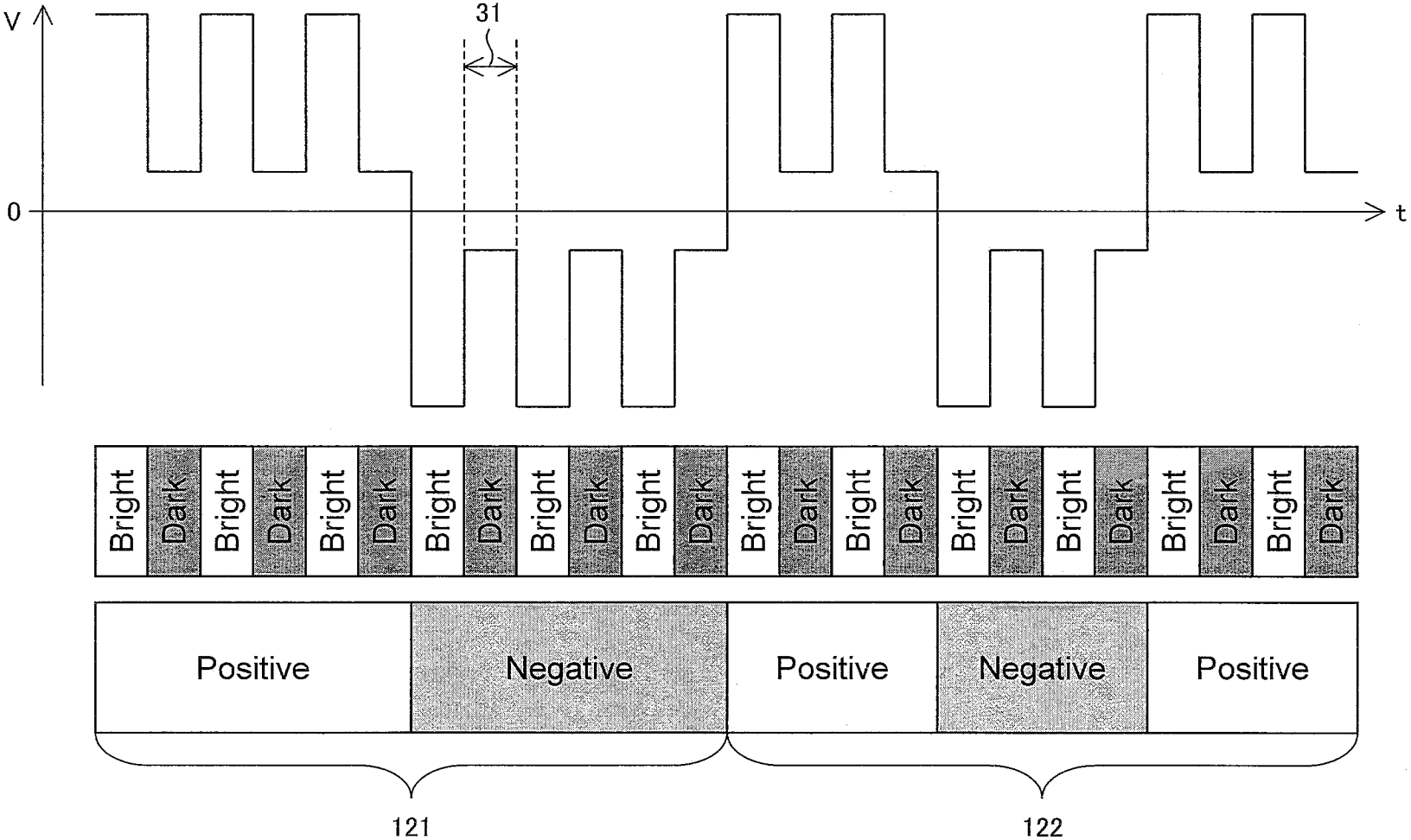

FIG. 12 illustrates (i) a waveform of a liquid crystal application voltage and (ii) transitions between brightness and darkness and between positive and negative polarities when a ratio of the bright and dark frame period to the positive and negative frame period is temporally changed.

FIG. 13

Figure 13:
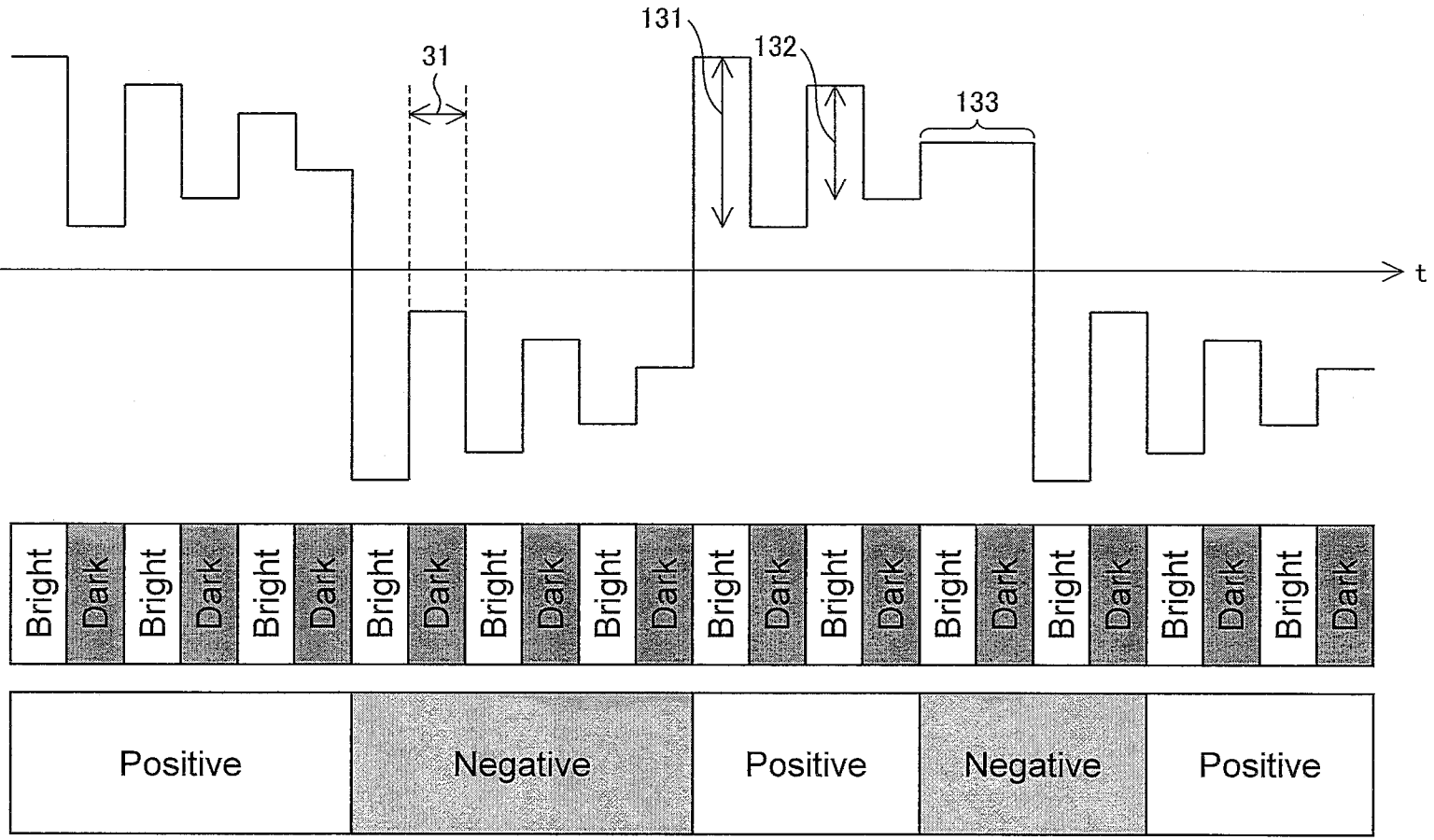

FIG. 13 illustrates (i) a waveform of a liquid crystal application voltage, (ii) a transition between brightness and darkness of luminance, and (iii) a transition between positive and negative polarities of the liquid crystal application voltage when each pixel is driven by temporarily changing (a) an amplitude of the liquid crystal application voltage at which the each pixel is driven at the bright luminance and (b) an amplitude of the liquid crystal application voltage at which the each pixel is driven at the dark luminance.

FIG. 14

Figure 14:
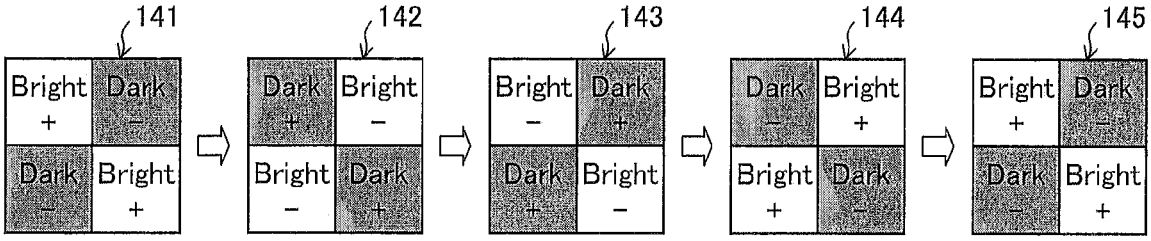

FIG. 14 illustrates transitions between brightness and darkness and between positive and negative polarities of four pixels contained in a unit when time-division driving and area-division driving are carried out with respect to the unit and dot reversal driving is carried out with respect to the liquid crystal display panel.

DESCRIPTION OF EMBODIMENTS

The following description discusses a first embodiment of the present invention with reference to FIGS. 1 through 14. The present embodiment takes, as an example of a liquid crystal display device, a mobile liquid crystal display device such as a mobile phone. However, the present invention is not limited to this.

(Structure of Liquid Crystal Display Device 10)

Figure 1:
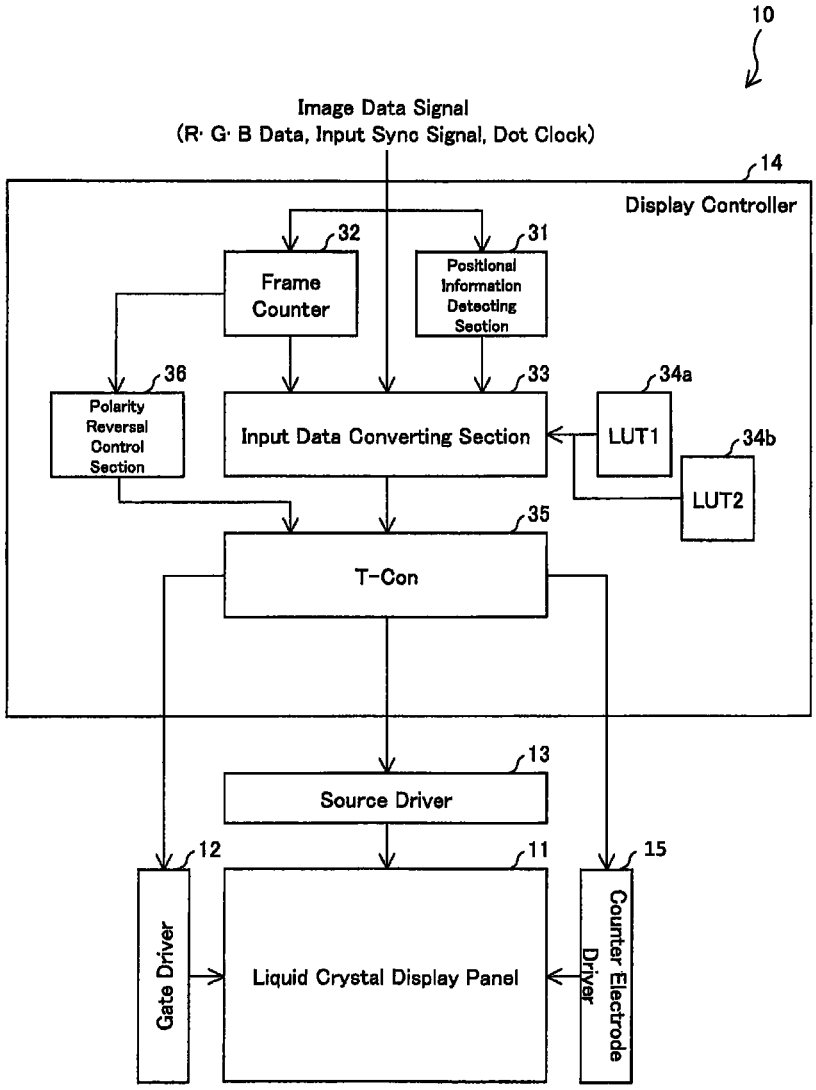
FIG. 1

FIG. 1 illustrates an arrangement of a relevant part of a liquid crystal display device 10 of the present embodiment. The liquid crystal display device 10 includes a liquid crystal display panel 11, a backlight (not illustrated), a gate driver 12, a source driver 13, and a display controller (a liquid crystal driving circuit, driving means) 14 (see FIG. 1).

The liquid crystal display panel 11 is an active matrix panel. Namely, the liquid crystal display panel 11 includes a liquid crystal layer which is provided between an active matrix substrate and a counter substrate. The present embodiment can employ an MVA mode, a TN mode, an IPS mode, and the like as a display mode of the liquid crystal display panel 11.

(Structure of Liquid Crystal Display Panel 11)

Figure 2:
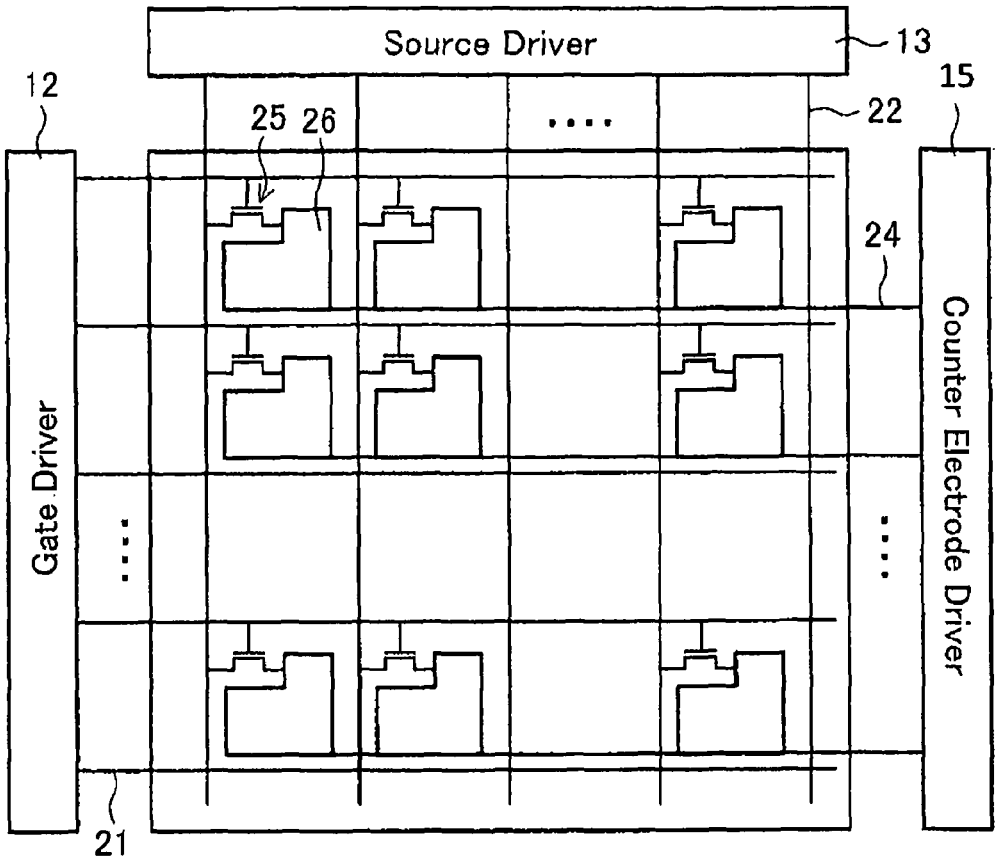
FIG. 2

FIG. 2 illustrates a structure of a relevant part of the liquid crystal display panel 11. The liquid crystal display panel 11 includes an active matrix substrate on which a plurality of scanning signal lines 21 are provided (see FIG. 2). Each of the plurality of scanning signal lines 21 is connected to a gate driver 12. A plurality of data signal lines 22 are further provided on the active matrix substrate so as to intersect the plurality of scanning signal lines 21. Each of the plurality of data signal lines 22 is connected to a source driver 13.

Intersections and lattices are provided at points at which the plurality of scanning signal lines 21 and the plurality of data signal lines 22 intersect with each other. TFTs 25 serving as switching elements are provided in the vicinity of the intersections and pixel electrodes 26 are provided in the respective lattices.

Each pixel is constituted by a pixel electrode 26. Each of the TFTs 25 applies a voltage to liquid crystal of the each pixel and controls an alignment of the liquid crystal, so as to control a transmittance at which backlight light is transmitted through the liquid crystal. The each pixel is provided with a counter electrode (not illustrated) which faces the pixel electrode 26. A plurality of counter electrode signal lines 24 which are parallel to the plurality of scanning signal lines 21 are provided in the liquid crystal display panel 11, and each counter electrode is connected to a corresponding counter electrode signal line 24.

The pixel electrode 26 is electrically connected to a corresponding TFT 25 (see FIG. 2). The TFT 25 which is instructed by a scanning signal supplied to a corresponding scanning signal line 21 to turn on connects a corresponding data signal line 22 and the pixel electrode 26, so as to supply, to the pixel electrode 26, a data signal to be transmitted to the data signal line 22. A polarity of a liquid crystal application voltage which is applied to the liquid crystal of the each pixel in this case is determined in accordance with a polarity of a signal to be supplied to a corresponding counter electrode signal line 24. This allows a display to be carried out in the each pixel at a luminance in accordance with an inputted data signal.

A backlight (not illustrated), which is provided on a backside of the liquid crystal display panel 11, emits light to a liquid crystal panel.

The liquid crystal display device 10 carries out so-called time-division driving with respect to each liquid crystal pixel constituting the liquid crystal display panel 11. The liquid crystal display device 10 also uses area-division driving in combination according to need. During the time-division driving, a consecutive plurality of vertical periods (a plurality of frames) are regarded as a unit cycle, and a temporal average of data displayed in each frame is regarded as display data for the unit cycle.

(Details of Display Controller 14)

The display controller 14 receives an image data signal from a signal source (not illustrated). According to the present embodiment, the display controller 14 receives, as image data signals, input gray scale data (R·G·B data), input sync signals (a vertical sync signal and a horizontal sync signal), and a dot clock. In a case where the liquid crystal display device 10 is a mobile phone, the signal source is exemplified by an image control system of the mobile phone. Alternatively, in a case where the liquid crystal display device 10 has a function of displaying a television broadcast, the signal source may be a receiving system for receiving a television broadcast. In accordance with these image data signals received, the display controller 14 generates a display drive signal for displaying an image in the liquid crystal display panel 11.

The display controller 14 includes a positional information detecting section 31, a frame counter 32, an input data converting section 33 (brightness or darkness determining means), two types of look-up tables 34*a* (LUT1) and 34*b* (LUT2), a timing controller 35, and a polarity reversal control section 36 (polarity determining means).

(Detection of Positional Information)

In accordance with data received, the positional information detecting section 31 detects which of pixels contained in a unit (described later) is to be displayed by use of inputted gray scale data. Then, the positional information detecting section 31 outputs a result of the detection as positional information.

(Frame Count)

In accordance with the inputted gray scale data and a corresponding vertical sync signal, the frame counter 32 finds frame information indicative of for which frame period of the unit cycle period (described above) the inputted gray scale data is. Specifically, the frame counter 32 counts an inputted vertical sync signal and finds the ordinal frame number of gray scale data corresponding to the inputted vertical sync signal, so as to output a result of the finding as the frame information.

(Polarity Reversal Control)

The polarity reversal control section 36 receives the frame information. In accordance with the received frame information, the polarity reversal control section 36 determines, in each frame, which of a voltage of the positive polarity and a voltage of the negative polarity to apply to the liquid crystal of the each pixel. Then, the polarity reversal control section 36 generates polarity information indicative of which of a voltage of the positive polarity and a voltage of the negative polarity to apply to the liquid crystal of the each pixel, so as to output the polarity information.

(Input Data Conversion)

The input data converting section 33 receives the frame information, the positional information, and the polarity information. In accordance with the frame information, the positional information, and the polarity information each corresponding to the inputted gray scale data, the input data converting section 33 converts the inputted gray scale data. Specifically, the inputted gray scale data is converted differently in accordance with a frame and a position of a pixel in a unit.

According to the present embodiment, the liquid crystal display device 10 uses the two types of the look-up tables 34*a* and 34*b* to carry out a gray scale data conversion process. The look-up tables 34*a* and 34*b* are arranged such that gray scale data to be supplied to the input data converting section 33 and gray scale data to be supplied from the input data converting section 33 have a one-to-one correspondence. The input data converting section 33 uses these LUTs to carry out the gray scale data conversion process. These LUTs are constituted by pairs of gray scale data which pairs are smaller in number than display gray scales. For gray scales which have no one-to-one correspondence, gray scale data may be derived by operation while being outputted.

In a case where these look-up tables are used, the gray scale data conversion process can be carried out by one of two types of methods. Namely, in accordance with the received frame information and the received positional information, the input data converting section 33 selects and uses one of the two types of the look-up tables 34*a* and 34*b*. It is preliminarily defined in each of the look-up tables which of the look-up tables to use in accordance with a frame and a position of a pixel in a unit.

According to the present embodiment, the input data converting section 33 converts the inputted gray scale data to gray scale data indicative of the bright luminance which is brighter than a specified luminance corresponding to the inputted gray scale data. Alternatively, the input data converting section 33 converts the inputted gray scale data to gray scale data indicative of the dark luminance which is darker than the specified luminance corresponding to the inputted gray scale data. In accordance with the frame information, the positional information, and the like, the input data converting section 33 determines to which of the gray scale data to convert the inputted gray scale data. Namely, in each frame, the input data converting section 33 determines at which of the bright luminance which is brighter than the specified luminance corresponding to the inputted gray scale data and the dark luminance which is darker than the specified luminance to drive the each pixel.

(Signal Output)

The timing controller 35 receives the gray scale data which has been subjected to the data conversion process and the polarity information. The timing controller 35 determines a timing at which a scanning signal line 21, a data signal line 22, and a counter electrode signal line 24 receive respective signals. Specifically, the timing controller 35 outputs, at a specified timing, various signals such as a clock signal and a start pulse signal which have been generated in accordance with an input sync signal, a counter electrode drive signal which has been generated in accordance with the polarity information, and the gray scale data which has been subjected to the data conversion process.

The various signals are supplied from the timing controller 35 to the scanning signal line 21, the data signal line 22, and the polarity information via the gate driver 12, the source driver 13, and the counter electrode driver 15, respectively. This allows the gray scale data to be supplied to the respective pixel electrodes 25 of the liquid crystal display panel 11 to be different in accordance with a frame.

The liquid crystal display device 10 can thus carry out time-division driving with respect to the each pixel of the liquid crystal display panel 11. Further, according to need, the liquid crystal display device 10 can not only carry out time-division driving with respect to the each pixel but also carry out area-division driving with respect to a unit containing a plurality of pixels.

(Example of Pixel Driving)

Figure 3:
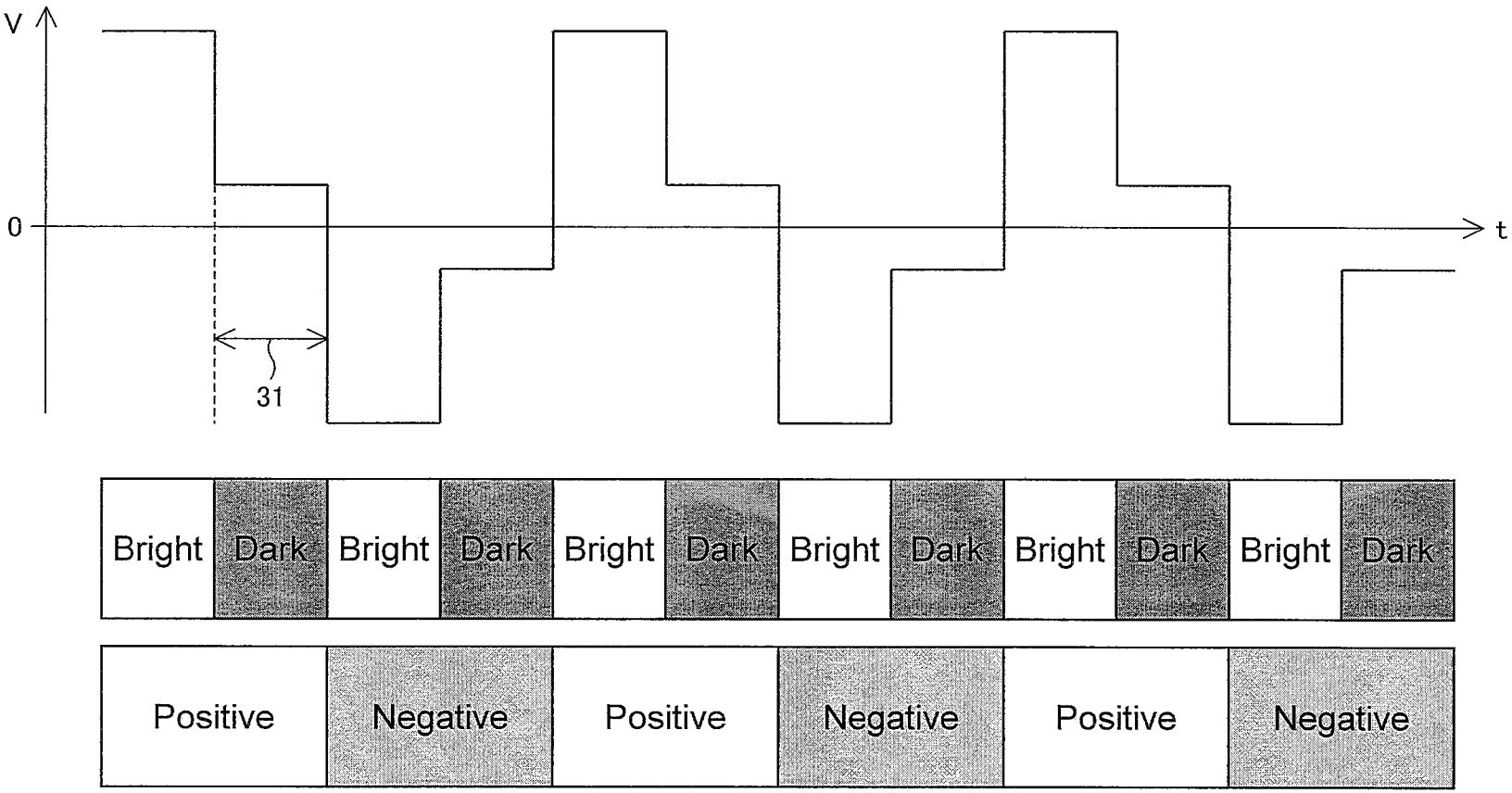
FIG. 3

FIG. 3 illustrates (i) a waveform of a liquid crystal application voltage and transitions between brightness and darkness of luminance and between positive and negative polarities in a case where time-division driving is carried out with respect to each pixel in a ratio of a bright and dark frame period to a positive and negative frame period of 1 to 2. A vertical axis indicates time elapsed from the start of driving of the each pixel and a transverse axis indicates an amplitude of a voltage applied to liquid crystal of the each pixel. "Bright" in FIG. 3 refers to a frame in which the each pixel is driven at the bright luminance brighter than a target luminance, and "dark" in FIG. 3 refers to a frame in which the each pixel is driven at the dark luminance darker than the target luminance. "Positive" in FIG. 3 refers to a frame in which a voltage of the positive polarity is applied to the liquid crystal of the each pixel, and "negative" in FIG. 3 refers to a frame in which a voltage of the negative polarity is applied to the liquid crystal of the each pixel. According to the present embodiment, the liquid crystal is driven at a frame rate of 60 Hz. Accordingly, one frame is approximately 1/60 second. Note that 31 in FIG. 3 indicates one frame period.

The liquid crystal display device 10 changes, every one frame, brightness and darkness of luminance at which the each pixel is driven. Namely, a period of brightness and darkness of luminance (the bright and dark frame period) is two frames. The liquid crystal display device 10 changes, every two frames, positive and negative polarities of the liquid crystal to be applied to the liquid crystal of the each pixel. Namely, a period of positive and negative polarities (the positive and negative frame period) of the liquid crystal application voltage is four frames.

A luminance of a pixel which is desired to be displayed is a so-called intermediate luminance in FIG. 3. Specifically, in a first frame, the liquid crystal display device 10 drives the pixel at the bright luminance brighter than the target luminance. The target luminance refers to a specified luminance which corresponds to original gray scale data. In a second frame following the first frame, the liquid crystal display device 10 drives the pixel at the dark luminance darker than the target luminance. Since a time for one frame is extremely short (1/60 second), a transition between brightness and darkness in this case is invisible to human beings. Instead, an average value of the bright luminance and the dark luminance is visible to human beings.

Since the average value is substantially identical to the target luminance, the target luminance which is originally desired to be displayed can be displayed without the need of displaying the intermediate luminance itself. Commonly, excess brightness is less likely to occur in a pixel at each of the bright luminance and the dark luminance than at the intermediate luminance. Accordingly, in a case where the average value is used to display the target luminance, it is possible to prevent occurrence of excess brightness and consequently to improve a viewing angle.

A pixel which has a brighter luminance causes the liquid crystal application voltage to have a larger amplitude. In contrast, a pixel which has a darker luminance causes the liquid crystal application voltage to have a smaller amplitude.

In FIG. 3, the liquid crystal display device 10 applies a voltage of a high amplitude and the positive polarity to the liquid crystal in the first frame. According to this, the liquid crystal display device 10 drives the each pixel at the bright luminance. The liquid crystal display device 10 applies a voltage of a low amplitude and the negative polarity to the liquid crystal in the following frame (second frame). According to this, the liquid crystal display device 10 drives the each pixel at the dark luminance. This causes the each pixel to have the target luminance. However, a voltage of the positive polarity continues to be applied to the liquid crystal. Namely, the liquid crystal application voltage has a polarity which is too positive.

The liquid crystal display device 10 applies a voltage of a high amplitude and the negative polarity to the liquid crystal in the following frame, i.e., the third frame. According to this, the liquid crystal display device 10 drives the each pixel at the bright luminance. The liquid crystal display device 10 applies a voltage of a low amplitude and the negative polarity to the liquid crystal in the following frame (fourth frame). According to this, the liquid crystal display device 10 drives the each pixel at the dark luminance. This causes the each pixel to have the target luminance. Namely, the each pixel continues to be displayed at the target luminance.

A sum of the amplitudes of the liquid crystal application voltage in these two frames (third and fourth frames) matches a sum of the amplitudes of the liquid crystal application voltage in the preceding two frames (first and second frames). The polarity of the liquid crystal application voltage in these two frames (third and fourth frames) and the polarity of the liquid crystal application voltage in the preceding two frames (first and second frames) are reverse to each other. Namely, one and the other of these polarities offset with each other. As a result, in a case where the liquid crystal application voltage in these four frames is averaged, the liquid crystal application voltage has a polarity which is neither too positive nor too negative.

(Advantage)

The liquid crystal display device 10 continues to apply a voltage to the liquid crystal constantly in the ratio of the bright and dark frame period to the positive and negative frame period of 1 to 2 (in a state in which the positive and negative frame period is twice the bright and dark frame period) (see FIG. 3). This allows the target luminance to continue to be displayed in the each pixel and allows a voltage whose polarity is neither too positive nor too negative to be applied to the liquid crystal of the each pixel. Such a liquid crystal voltage application method is applicable to not only a particular pixel but also all pixels of the liquid crystal display panel 11. As a result, according to the liquid crystal display device 10 of the present invention, it is possible to improve a viewing angle by carrying out time-division driving with respect to each pixel, prevent an image display with lower reliability, and reduce stripes in an image to be displayed.

(Another Ratio)

Figure 4:
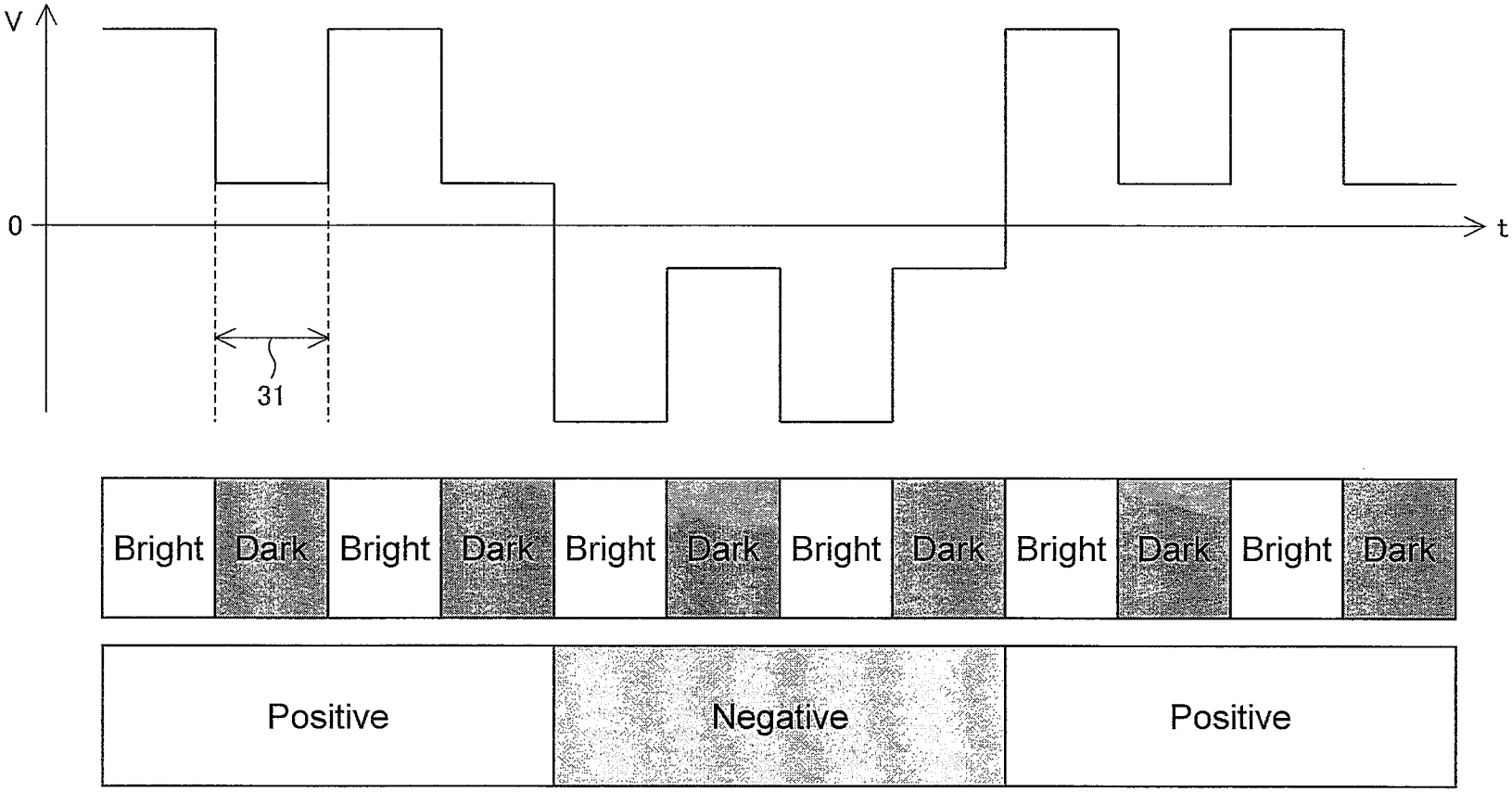
FIG. 4

The ratio of the bright and dark frame period to the positive and negative frame period is not limited to 1 to 2 (described above) and can be set to another ratio. FIG. 4 illustrates an example of this. FIG. 4 illustrates (i) a waveform of a liquid crystal application voltage and (ii) transitions between brightness and darkness of luminance and between positive and negative polarities in a case where time-division driving is carried out with respect to each pixel in a ratio of the bright and dark frame period to the positive and negative frame period of 1 to 4.

The ratio of the bright and dark frame period to the positive and negative frame period is 1 to 4 in the example shown in FIG. 4. Specifically, the bright and dark frame period is two frames, and the positive and negative frame period is eight frames. Namely, brightness and darkness of luminance are reversed every one frame, and the polarities of the liquid crystal application voltage are reversed every four frames. In this case, the positive polarity and the negative polarity are totally identical in sum of the liquid crystal application voltage every four frames. Accordingly, the liquid crystal application voltage applied to the each pixel has a polarity which is perfectly neither too positive nor too negative at the end of the positive and negative frame period of eight frames. As a result, it is possible to improve a viewing angle by carrying out time-division driving with respect to each pixel, prevent an image display with lower reliability, and reduce stripes in an image to be displayed.

(Case where Bright and Dark Frame Period>Positive and Negative Frame Period)

Figure 5:
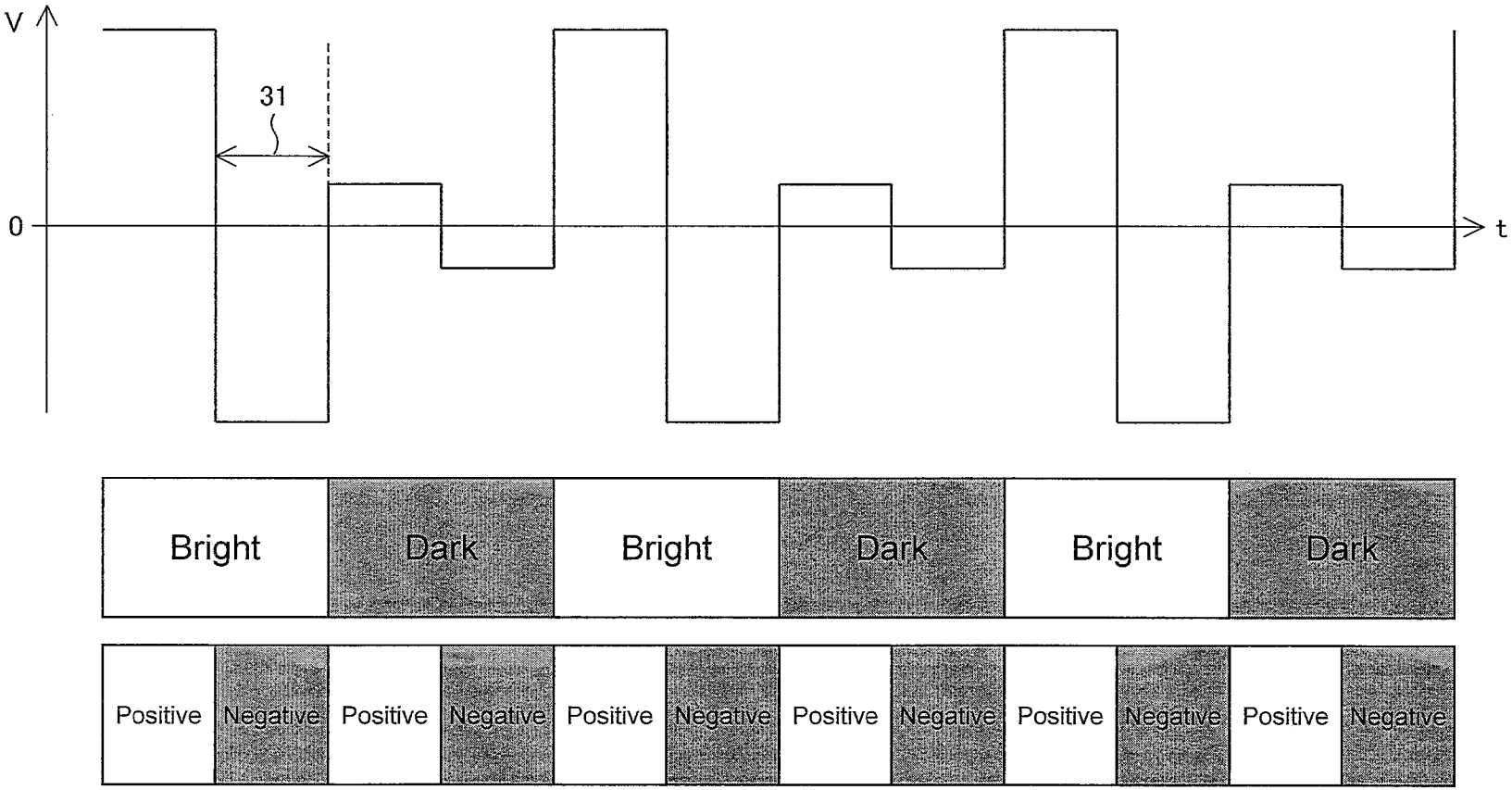
FIG. 5

The inequality of the bright and dark frame period<the positive and negative frame period holds in the examples described above (FIGS. 3 and 4), which are different in ratio. However, according to the liquid crystal display device 10, an effect of the present invention can be obtained provided that the bright and dark frame period and the positive and negative frame period are different from each other. Accordingly, a luminance may be driven based on the inequality of the bright and dark frame period >the positive and negative frame period. FIG. 5 illustrates an example of this. FIG. 5 illustrates (i) a waveform of a liquid crystal application voltage and (ii) transitions between brightness and darkness of luminance and between positive and negative polarities in a case where time-division driving is carried out with respect to each pixel in a ratio of the bright and dark frame period to the positive and negative frame period of 2 to 1.

The ratio of the bright and dark frame period to the positive and negative frame period is 2 to 1 in the example shown in FIG. 5. Namely, the positive and negative frame period <the bright and dark frame period. More specifically, the bright and dark frame period is four frames, and the positive and negative frame period is two frames. Namely, brightness and darkness of luminance are reversed every two frames, and the polarities of the liquid crystal application voltage are reversed every one frame. In this case, the positive polarity and the negative polarity are totally identical in sum of the liquid crystal application voltage every two frames. Accordingly, the liquid crystal application voltage applied to the each pixel has a polarity which is perfectly neither too positive nor too negative at the end of the positive and negative frame period of four frames. As a result, it is possible to improve a viewing angle by carrying out time-division driving with respect to each pixel, prevent an image display with lower reliability, and reduce stripes in an image to be displayed.

(Combination of Time-division Driving and Area-division Driving)

The liquid crystal display device 10 can use area-division driving in combination with time-division driving (described above). Specifically, the liquid crystal display device 10 carries out time-division driving with respect to the each pixel and also regards a group of a plurality of pixels as a unit. Further, the liquid crystal display device 10 drives the plurality of pixels contained in the unit in an identical frame period at the bright luminance or the dark luminance. This causes an average value of display luminances of the respective plurality of pixels which are contained in the unit and driven in the identical frame period to match the target luminance.

Figure 6:
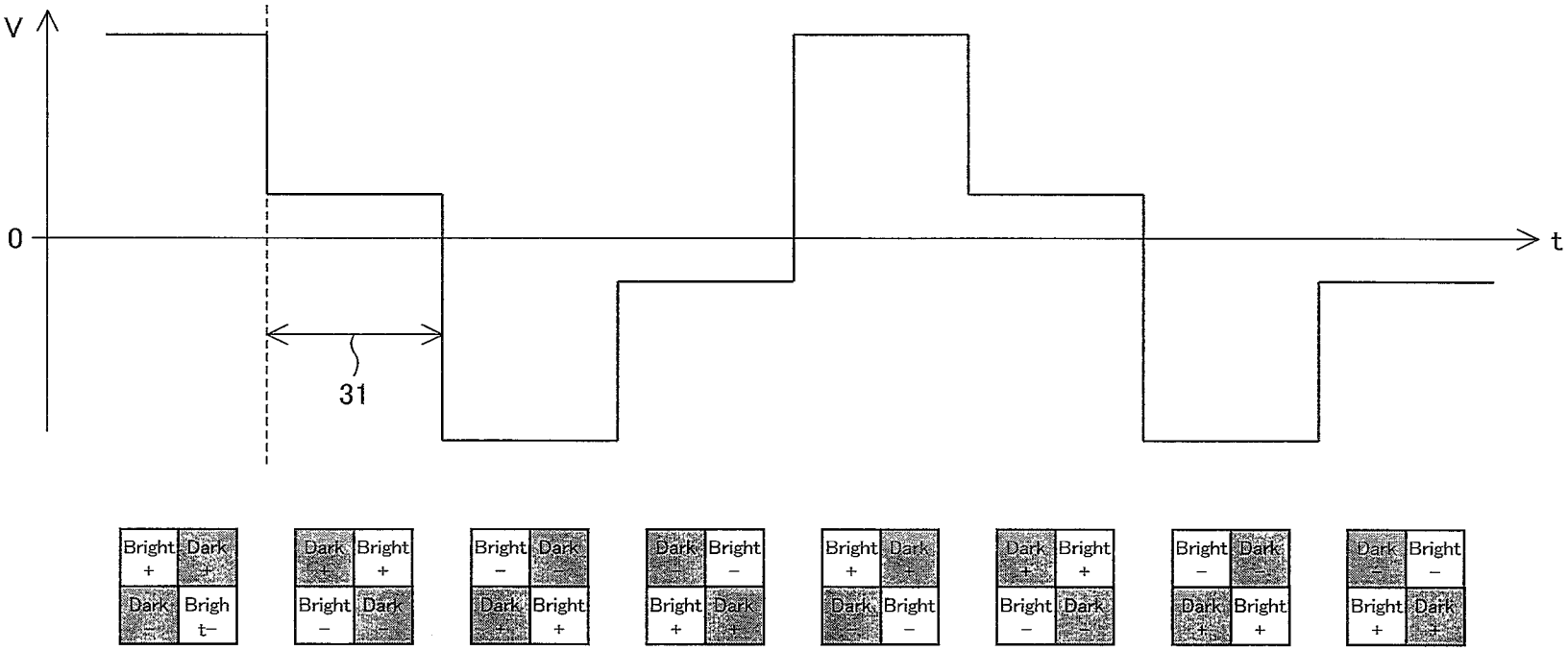
FIG. 6

FIG. 6 shows an example of a combination of time-division driving and area-division driving. FIG. 6 illustrates transitions between brightness and darkness and between positive and negative polarities of four pixels contained in a unit when time-division driving and area-division driving are carried out with respect to the unit and line reversal driving is carried out with respect to the liquid crystal display panel 11.

The ratio of the bright and dark frame period to the positive and negative frame period is 1 to 2 in the each pixel in the example shown in FIG. 6 (as in the case of FIG. 3). Namely, the bright and dark frame period is two frames, and the positive and negative frame period is four frames. Further, the liquid crystal display device 10 drives four pixels contained in a unit in a mosaic pattern at the bright luminance or the dark luminance. The liquid crystal display device 10 also carries out line reversal driving with respect to the liquid crystal display panel 11. Note that the waveform illustrated in FIG. 6 is a waveform of a liquid crystal application voltage applied to the pixel on the upper left of the unit.

Also in a case where the liquid crystal display device 10 carries out area-division driving with respect to the unit, carries out time-division driving with respect to each of the four pixels contained in the unit, and carries out line reversal driving with respect to the liquid crystal display panel 11, the ratio of the bright and dark frame period to the positive and negative frame period is 1 to 2 in the each of the four pixels (see FIG. 6). Accordingly, a liquid crystal application voltage applied to the each of the four pixels has a polarity which is neither too positive nor too negative. As a result, it is possible to improve a viewing angle by carrying out time-division driving with respect to each pixel, prevent an image display with lower reliability, and reduce stripes in an image to be displayed.

A pixel which is driven at the bright luminance and a pixel which is driven at the dark luminance are provided so as to be vertically adjacent to each other in each unit in the example shown in FIG. 6. Such a relationship is maintained in each frame. This can prevent occurrence of a flicker due to reversal of brightness and darkness.

In the example shown in FIG. 6, the liquid crystal display device 10 also carries out line reversal driving in which polarities of a liquid crystal application voltage to be applied to each pixel constituting the liquid crystal display panel 11 are reversed for each operation signal line connected to the each pixel. According to this, it is unnecessary to increase a spatial polarity reversal period (pitch). Consequently, line reversal driving utilizes an advantage of being carried out at a lower voltage than dot reversal driving. In addition, differently from dot inversion driving, line reversal driving causes no problem of increasing a pitch.

(Reason Why Line Reversal Driving is Desirable)

It is more preferable in the present invention to carry out line reversal driving than to carry out dot reversal driving. The following description discusses a reason for this.

Line reversal and dot reversal are different in spatial polarity reversal period (spatial polarity pitch). Normally, line reversal driving has a disadvantage of having a larger spatial polarity pitch. A larger spatial polarity pitch causes a rough appearance. In contrast, line reversal driving has an advantage of being carried out at a lower voltage than dot reversal driving.

Namely, in a case where dot reversal driving is carried out in the present invention, a problem of causing a deterioration in spatial polarity pitch occurs though dot reversal driving is advantageous in its spatial polarity pitch. In contrast, line reversal driving can be carried out in the present invention without changing a spatial polarity pitch and can maintain its advantage (a low voltage) as it is. Accordingly, line reversal driving can be carried out more reasonably than dot reversal driving in the present invention.

The following description discusses, with reference to FIG. 14, the reason why a spatial polarity pitch is forced to be larger in a case where dot inversion driving is carried out in the present invention. FIG. 14 illustrates transitions between brightness and darkness and between positive and negative polarities of four pixels contained in a unit when time-division driving and area-division driving are carried out with respect to the unit and dot reversal driving is carried out with respect to the liquid crystal display panel.

In each frame, a unit constantly contains only two types of pixels (see FIG. 14). Specifically, in a frame, a unit contains only a pixel of the bright luminance and the positive polarity and a pixel of the dark luminance and the negative polarity (see 141, 144, and 145 in FIG. 14). In another frame, a unit contains only a pixel of the bright luminance and the negative polarity and a pixel of the dark luminance and the positive polarity (see 142 and 143 in FIG. 14).

In contrast, in a case where line reversal driving is carried out, in each frame, a unit constantly contains four types of pixels, i.e., a pixel of the bright luminance and the positive polarity, a pixel of the bright luminance and the negative polarity, a pixel of the dark luminance and the positive polarity, and a pixel of the dark luminance and the negative polarity (see FIG. 6). Accordingly, dot reversal driving causes only two types of pixels to display a screen, whereas line reversal driving causes four types of pixels to display a screen.

Normally, a pixel of the bright luminance and the positive polarity and a pixel of the bright luminance and the negative polarity are adjusted to be displayed at an identical luminance though the pixels are different in polarity. Same applies to a pixel of the dark luminance and the positive polarity and a pixel of the dark luminance and the negative polarity. However, the pixels cannot be displayed at a perfectly identical luminance in either case. Accordingly, a unit which contains only a pixel of the bright luminance and the negative polarity and a pixel of the dark luminance and the positive polarity and a unit which contains only a pixel of the bright luminance and the positive polarity and a pixel of the dark luminance and the negative polarity are slightly different in luminance. Such a difference causes a flicker in a screen. In addition, such a flicker, which occurs every two frames, becomes more conspicuous.

In order to prevent such a flicker, it is necessary to, for example, carry out polarity reversal vertically or transversely every two pixel periods. This causes a deterioration in advantage (characteristic) of dot reversal.

In contrast, line reversal driving, which has no disadvantage that occurs in dot reversal driving (described above), can be employed more reasonably.

(Driving of Subpixel)

Each pixel of the liquid crystal display panel 11 may be constituted by a plurality of subpixels. In this case, brightness and darkness of the each pixel for each frame is determined in accordance with a combination of brightness and darkness of the plurality of subpixels constituting the each pixel. FIG. 7 shows an example of this. (a) of FIG. 7 shows an example of a combination of brightness and darkness of a subpixel which combination determines brightness and darkness of each pixel constituted by three subpixels which are arranged in a vertical stripe pattern. (b) of FIG. 7 shows an example of a combination of brightness and darkness of a subpixel which combination determines brightness and darkness of each pixel constituted by three subpixels which are arranged in a transverse stripe pattern.

Each pixel is constituted by three subpixels in the examples shown in (a) of FIG. 7 and (b) of FIG. 7. Three subpixels are arranged in a vertical stripe pattern in (a) of FIG. 7. Namely, a pixel is constituted by three vertically-long subpixels which are transversely juxtaposed to each other. In contrast, three subpixels are arranged in a transverse stripe pattern in (a) of FIG. 7. Namely, a pixel is constituted by three transversely-long subpixels which are vertically juxtaposed to each other.

A pixel in which more subpixels of the bright luminance are arranged than subpixels of the dark luminance in a pixel has the bright luminance. For example, a pixel in which a subpixel of the bright luminance, a subpixel of the dark luminance, and a subpixel of the bright luminance are arranged has the bright luminance (see 71 in (a) of FIG. 7). Also a pixel in which each of three subpixels has the bright luminance has the bright luminance (see 72 in FIG. 7).

A pixel in which more subpixels of the dark luminance are arranged than subpixels of the dark luminance in a pixel has the dark luminance. For example, a pixel in which a subpixel of the dark luminance, a subpixel of the bright luminance, and a subpixel of the dark luminance are arranged has the dark luminance (see 73 in (b) of FIG. 7). Also a pixel in which each of three subpixels has the dark luminance has the dark luminance (see 74 in FIG. 7).

(Area-division Driving)

The liquid crystal display device 10 can carry out area-division driving with respect to a unit which contains a plurality of pixels each constituted by a plurality of subpixels (see FIG. 7). FIG. 8 shows an example of this. (a) of FIG. 8 illustrates a state of brightness and darkness and polarities of subpixels when time-division driving and area-division driving are carried out in a first frame with respect to a unit containing four pixels each constituted by three subpixels. (b) of FIG. 8 illustrates a state of brightness and darkness and polarities of subpixels when time-division driving and area-division driving are carried out in a second frame following the first frame with respect to a unit containing four pixels each constituted by three subpixels.

The liquid crystal display device 10 carries out line reversal driving with respect to the liquid crystal display panel 11 in each of the examples shown in (a) of FIG. 8 and (b) of FIG. 8. A unit contains four pixels, each of which is constituted by three subpixels. Two pixels have the bright luminance and the other two pixels have the dark luminance in (a) of FIG. 8. A pixel of the bright luminance and a pixel of the dark luminance are arranged alternately (in a mosaic pattern). The liquid crystal display device 10 causes such a combination to drive the unit at the target luminance.

Note here that a pixel of the bright luminance can be obtained by combining two subpixels of the bright luminance and a subpixel of the dark luminance (see 81 in (a) of FIG. 8). Note also that a pixel of the dark luminance can be obtained by combining a subpixel of the bright luminance and two subpixels of the dark luminance.

Alternatively, a pixel of the bright luminance can also be obtained by combining three subpixels of the bright luminance (see 82 in (a) of FIG. 8). A pixel of the dark luminance can also be obtained by combining three subpixels of the dark luminance.

In any case, a luminance of each pixel is determined by averaging luminances of respective subpixels constituting the each pixel. An average luminance of a unit is determined by averaging luminances of respective pixels contained in the unit. The average luminance determined in this case is substantially identical to the target luminance.

In (b) of FIG. 8, the liquid crystal display device 10 has reversed a state of brightness and darkness of subpixels which state is illustrated in (a) of FIG. 8. However, the liquid crystal display device 10 maintains a liquid crystal application voltage at an identical value without reversing polarities of the liquid crystal application voltage. Accordingly, a pixel of the bright luminance can be obtained by combining two subpixels of the bright luminance and a subpixel of the dark luminance (see 83 in (b) of FIG. 8). A pixel of the dark luminance can be obtained by combining a subpixel of the bright luminance and two subpixels of the dark luminance. Alternatively, a pixel of the bright luminance can also be obtained by combining three subpixels of the bright luminance (see 84 in (b) of FIG. 8). A pixel of the dark luminance can also be obtained by combining three subpixels of the dark luminance.

The ratio of the bright and dark frame period to the positive and negative frame period is 1 to 2 in each of the subpixels also in each of the cases of FIGS. 7 and 8. Accordingly, it is possible to improve a viewing angle by carrying out time-division driving with respect to each pixel, prevent an image display with lower reliability, and reduce stripes in an image to be displayed.

In the example shown in FIG. 8, the pixels contained in each unit are arranged such that a subpixel driven at the bright luminance and a pixel driven at the dark luminance are vertically juxtaposed to each other (see 81 and 83 in FIG. 8). Such a relationship is maintained in each frame. This can further prevent occurrence of a flicker due to reversal of brightness and darkness.

(Reversal of Polarities of Liquid Crystal Application Voltage Applied to Subpixels for Each Frame)

FIG. 9 illustrates a state of brightness and darkness and polarities of liquid crystal subpixels when each pixel is constituted by three subpixels which are arranged in a transverse stripe pattern and polarities of a liquid crystal application voltage are reversed for each subpixel in an identical frame.

In the example shown in FIG. 9, in the liquid crystal display panel 11, a scanning signal line is provided for each subpixel arranged in a column. The liquid crystal display device 10 carries out line reversal driving in which polarities of a liquid crystal application voltage to be applied to each of the subpixels constituting the liquid crystal display panel 11 are reversed for each of operation signal lines connected to the respective subpixels.

A pixel in which a subpixel of the bright luminance, a subpixel of the dark luminance, and a subpixel of the bright luminance are arranged has the bright luminance (see 91 in FIG. 9). A pixel in which each of three subpixels has the bright luminance also has the bright luminance (see 92 in FIG. 9). These points are similar to those in the case of (b) of FIG. 7. However, in the example shown in FIG. 9, polarities of the liquid crystal application voltage are reversed for each subpixel even in an identical frame period.

In contrast, a pixel in which a subpixel of the dark luminance, a subpixel of the bright luminance, and a subpixel of the dark luminance are arranged has the dark luminance (see 93 in FIG. 9). A pixel in which each of three subpixels has the dark luminance also has the dark luminance (see 94 in FIG. 9). These points are also similar to those in the case of (b) of FIG. 7. However, in the example shown in FIG. 9, polarities of the liquid crystal application voltage are reversed for each subpixel even in an identical frame period.

The liquid crystal display device 10 determines a luminance of a pixel by driving each subpixel as illustrated in FIG. 9. The liquid crystal display device 10 can further carry out area-division driving with respect to a unit formed by combining a plurality of pixels thus driven. FIG. 10 shows an example of this.

(a) of FIG. 10 illustrates a state of brightness and darkness and polarities of subpixels when time-division driving and area-division driving are carried out in a first frame with respect to a unit containing four pixels each constituted by three subpixels and polarities of a liquid crystal application voltage applied to each of the three subpixels are reversed in the first frame. (b) of FIG. 10 illustrates a state of brightness and darkness and polarities of subpixels when time-division driving and area-division driving are carried out in a second frame following the first frame with respect to a unit containing four pixels each constituted by three subpixels and polarities of a liquid crystal application voltage applied to each of the three subpixels are reversed in the second frame.

The liquid crystal display device 10 carries out line reversal driving with respect to the liquid crystal display panel 11 in each of the examples shown in (a) of FIG. 10 and (b) of FIG. 10. Specifically, polarities of the liquid crystal application voltage are reversed for each subpixel in a line constituting the liquid crystal display panel 11. A unit contains four pixels, each of which is constituted by three subpixels.

Two pixels have the bright luminance and the other two pixels have the dark luminance in each of (a) of FIG. 10 and (b) of FIG. 10. A pixel of the bright luminance and a pixel of the dark luminance are arranged alternately (in a mosaic pattern). The liquid crystal display device 10 causes such a combination to drive the unit at the target luminance. Further, in an identical frame, the liquid crystal display device 10 reverses the polarities of the liquid crystal application voltage applied to each of the subpixels.

A pixel of the bright luminance can be obtained by combining two subpixels of the bright luminance and a subpixel of the dark luminance (see 101 in (a) of FIG. 10). A pixel of the dark luminance can be obtained by combining a subpixel of the bright luminance and two subpixels of the dark luminance.

Alternatively, a pixel of the bright luminance can also be obtained by combining three subpixels of the bright luminance (see 102 in (a) of FIG. 10). A pixel of the dark luminance can also be obtained by combining three subpixels of the dark luminance.

In (b) of FIG. 10, the liquid crystal display device 10 has reversed a state of brightness and darkness of subpixels which state is illustrated in (a) of FIG. 10. However, the liquid crystal display device 10 maintains the liquid crystal application voltage at an identical value without reversing polarities of the liquid crystal application voltage. Namely, in an identical frame, the liquid crystal display device 10 maintains reversal of the polarities of the liquid crystal application voltage applied to each of the subpixels.

A pixel of the bright luminance can be obtained by combining two subpixels of the bright luminance and a subpixel of the dark luminance (see 103 in (b) of FIG. 10). A pixel of the dark luminance can be obtained by combining a subpixel of the bright luminance and two subpixels of the dark luminance.

Alternatively, a pixel of the bright luminance can also be obtained by combining three subpixels of the bright luminance (see 104 in (b) of FIG. 10). A pixel of the dark luminance can also be obtained by combining three subpixels of the dark luminance.

The ratio of the bright and dark frame period to the positive and negative frame period is 1 to 2 in each of the subpixels also in the cases of FIG. 10. Accordingly, it is possible to improve a viewing angle by carrying out time-division driving with respect to each pixel, prevent an image display with lower reliability, and reduce stripes in an image to be displayed.

As described above, line reversal driving is carried out for each subpixel in each of the examples shown in FIGS. 9 and 10. Accordingly, a spatial polarity reversal period (pitch) can be smaller in this case than in a case where line reversal driving is carried out for each pixel.

(Another Example of Line Reversal Driving)

FIG. 11 illustrates transitions between brightness and darkness and between positive and negative polarities of four pixels contained in a unit when time-division driving and area-division driving are carried out with respect to the unit and line reversal driving is carried out with respect to the liquid crystal display panel 11. The ratio of the bright and dark frame period to the positive and negative frame period is 2 to 1 in the example shown in FIG. 11 (as in the case of FIG. 5). Namely, the bright and dark frame period is four frames, and the positive and negative frame period is two frames. Further, the liquid crystal display device 10 drives four pixels contained in a unit in a mosaic pattern at the bright luminance or the dark luminance. The liquid crystal display device 10 also carries out line reversal driving with respect to the liquid crystal display panel 11. Note that the waveform illustrated in FIG. 11 is a waveform of a liquid crystal application voltage applied to the pixel on the upper left of the unit.

Also in a case where the liquid crystal display device 10 carries out area-division driving with respect to the unit, carries out time-division driving with respect to each of the four pixels contained in the unit, and carries out line reversal driving with respect to the liquid crystal display panel 11, the ratio of the bright and dark frame period to the positive and negative frame period is 2 to 1 in the each of the four pixels (see FIG. 11). Accordingly, a liquid crystal application voltage applied to the each of the four pixels has a polarity which is neither too positive nor too negative. As a result, it is possible to improve a viewing angle by carrying out time-division driving with respect to each pixel, prevent an image display with lower reliability, and reduce stripes in an image to be displayed.

(Effect of the Present Invention)

As described above, according to the liquid crystal display device 10, an effect of the present invention can be obtained in a case where the bright and dark frame period and the positive and negative frame period are different from each other. Namely, a polarity of a liquid crystal application voltage can be prevented from being either too positive or too negative. Alternatively, in a case where the bright and dark frame period is an integral multiple of the positive and negative frame period or the positive and negative frame period is an integral multiple of the bright and dark frame period, the polarity of the liquid crystal application voltage can be further prevented from being either too positive or too negative.

The ratio of the bright and dark frame period to the positive and negative frame period is most typified by 1 to 2 (namely, the bright and dark frame period is two frames and the positive and negative frame period is four frames). It is preferable that the bright and dark frame period be as short as possible. It is practically desirable that the bright and dark frame period be not more than 1/20 second. This is because, in a case where a frequency at which brightness and darkness reverse exceeds 20 Hz, a flicker becomes conspicuous in an image. In contrast, it is also preferable that the positive and negative frame period be as short as possible. However, no problem occurs in practice provided that the positive and negative frame period is not more than 1/25 second. This is because a timing at which polarities reverse is less visible than a timing at which brightness and darkness reverse.

The following description discusses the reason why it is preferable that the bright and dark frame period be two frames and the positive and negative frame period be four frames. Normally, liquid crystal is driven at a frame frequency of 60 Hz. In this case, the bright and dark frame period is fixed to two frames (namely, brightness and darkness of luminance are reversed every one frame). As described above, it is preferable that both the bright and dark frame period and the positive and negative frame period be as short as possible. It is also preferable that the positive and negative frame period be an integral multiple of the bright and dark frame period. In this case, the ratio of the bright and dark frame period to the positive and negative frame period can be 1 to 2 at minimum. Accordingly, since the bright and dark frame period is two frames, the positive and negative frame period is four frames.

Note that the ratio of the bright and dark frame period to the positive and negative frame period can be a ratio other than 1 to 2 by setting, to not less than 60 Hz, the frame frequency at which the liquid crystal is driven. In a case where the frame frequency at which the liquid crystal is driven is set to 120 Hz, the bright and dark frame period can be not only two frames but also four frames, for example. In this case, the positive and negative frame period can be two frames, and the ratio of the bright and dark frame period to the positive and negative frame period is accordingly 2 to 1. However, even in such a case where another ratio can be selected, it is the most preferable that the ratio of the bright and dark frame period to the positive and negative frame period be 1 to 2 (the bright and dark frame period be two frames and the positive and negative frame period be four frames).

(Example of Causing Frequency Ratio to be Variable)

The ratio of the bright and dark frame period to the positive and negative frame period does not necessarily need to be constantly uniform and may be temporally changed. FIG. 12 shows an example of this.

FIG. 12 illustrates (i) a waveform of a liquid crystal application voltage and (ii) transitions between brightness and darkness and between positive and negative polarities when a ratio of the bright and dark frame period to the positive and negative frame period is temporally changed. The ratio of the bright and dark frame period to the positive and negative frame period is 1 to 6 in the frame period (see 121 in FIG. 12). In contrast, the ratio of the bright and dark frame period to the positive and negative frame period is 1 to 4 in the frame period (see 122 in FIG. 12). In either frame period, a sum of the liquid crystal application voltage of the positive polarity and a sum of the liquid crystal application voltage of the dark luminance are equal to each other. Accordingly, no voltage that has a polarity which is either too positive or too negative continues to be applied to the liquid crystal. As a result, it is possible to improve a viewing angle by carrying out time-division driving with respect to each pixel, prevent an image display with lower reliability, and reduce stripes in an image to be displayed.

(Temporal Change in Amplitude of Liquid Crystal Application Voltage)

According to the liquid crystal display device 10, an amplitude of the liquid crystal application voltage at which the each pixel is driven at the bright luminance and an amplitude of the liquid crystal application voltage at which the each pixel is driven at the dark luminance do not necessarily need to be constantly fixed. Namely, the amplitudes may be temporarily changed. FIG. 13 shows an example of this.

FIG. 13 illustrates (i) a waveform of a liquid crystal application voltage, (ii) a transition between brightness and darkness of luminance, and (iii) a transition between positive and negative polarities of the liquid crystal application voltage when each pixel is driven by temporarily changing (a) an amplitude of the liquid crystal application voltage at which the each pixel is driven at the bright luminance and (b) an amplitude of the liquid crystal application voltage at which the each pixel is driven at the dark luminance. The ratio of the bright and dark frame period to the positive and negative frame period is 1 to 6 in the example shown in FIG. 13. The liquid crystal display device 10 reverses brightness and darkness of luminance of the each pixel every one frame. Further, in a frame period in which the liquid crystal application voltage has the positive polarity, the liquid crystal display device 10 gradually reduces the amplitude of the liquid crystal application voltage at which the each pixel is driven at the bright luminance (see 131 and 132 in FIG. 13). In contrast, in the same frame period, the liquid crystal display device 10 gradually increases the amplitude of the liquid crystal application voltage at which the each pixel is driven at the dark luminance.

In a case where a value of the bright luminance of a pixel in a first frame and a value of the dark luminance of the pixel in a second frame following the first frame are averaged irrespective of the amplitude of the liquid crystal application voltage in each frame, a constantly identical value, i.e., a value substantially equal to the target luminance can be obtained. Accordingly, the each pixel continues to be driven at the target luminance irrespective of the amplitude of the liquid crystal application voltage.

The example shown in FIG. 13 assumes that a half of the bright and dark frame period starts every time the amplitude of the liquid crystal application voltage changes. Namely, it is assumed that irrespective of the amplitude, a first frame corresponding to the bright luminance and a second frame following the first frame and corresponding to the dark luminance are equivalent to the bright and dark frame period. Accordingly, also in a case where there is little difference in amplitude between the liquid crystal application voltage at which the each pixel is driven at the bright luminance and the liquid crystal application voltage at which the each pixel is driven at the dark luminance, two consecutive frames are combined, so as to be a single bright and dark frame period (see 133 in FIG. 13).

As described earlier, a liquid crystal driving circuit in accordance with the present invention which carries out time-division driving with respect to each pixel constituting an active matrix liquid crystal display panel, the liquid crystal driving circuit includes: brightness or darkness determining means for determining at which of a bright luminance and a dark luminance to drive the each pixel in each frame, the bright luminance being brighter than a specified luminance which corresponds to inputted gray scale data, the dark luminance being darker than the specified luminance; polarity determining means for determining which of a voltage of a positive polarity and a voltage of a negative polarity to apply to liquid crystal of the each pixel in the each frame; and driving means for driving the each pixel by causing a bright and dark frame period and a positive and negative frame period to be different from each other, the bright and dark frame period being a period of brightness and darkness of luminance at which to drive the each pixel, the positive and negative frame period being a period of polarities of the voltage to be applied to the liquid crystal of the each pixel. It is preferable that the driving means drive the each pixel by causing the positive and negative frame period to be an integral multiple of the bright and dark frame period.

According to the configuration, in a positive and negative frame period, a sum of amplitudes of a liquid crystal application voltage which is applied to the each pixel and has the positive polarity matches a sum of amplitudes of the liquid crystal application voltage which is applied to the each pixel and has the negative polarity. Accordingly, the liquid crystal application voltage applied to the each pixel has a polarity which is perfectly neither too positive nor too negative every one positive and negative frame period. As a result, it is possible to improve a viewing angle by carrying out time-division driving with respect to each pixel, prevent an image display with lower reliability, and reduce stripes in an image to be displayed.

It is preferable that the driving means drive the each pixel by causing the positive and negative frame period to be twice the bright and dark frame period.

The configuration allows the liquid crystal driving circuit to be more practically used.

It is preferable that the driving means drive the each pixel by causing the bright and dark frame period to be two frames and causing the positive and negative frame period to be four frames.

It is preferable that the driving means drive the each pixel by causing the bright and dark frame period to be an integral multiple of the positive and negative frame period.

According to the configuration, the liquid crystal application voltage applied to the each pixel has a polarity which is perfectly neither too positive nor too negative. As a result, it is possible to improve a viewing angle by carrying out time-division driving with respect to each pixel, prevent an image display with lower reliability, and reduce stripes in an image to be displayed.

The liquid crystal driving circuit as set forth in any one of claims 1 through 5, wherein regarding a plurality of pixels as a unit, the driving means drives, in a frame, (i) any of the plurality of pixels of the unit at the bright luminance and (ii) the other pixels of the unit at the dark luminance.

According to the configuration, the liquid crystal driving circuit carries out time-division driving with respect to the each pixel and carries out area-division driving with respect to a unit constituted by a plurality of pixels. This further improves a viewing angle of the entire image.

It is preferable that in the driving means, a pixel driven at the bright luminance and a pixel driven at the dark luminance be provided so as to be vertically adjacent to each other in the unit.

The configuration can prevent occurrence of a flicker due to reversal of brightness and darkness.

It is preferable that: each of the plurality of pixels contained in the unit be constituted by a plurality of subpixels; and in the driving means, a subpixel driven at the bright luminance and a subpixel driven at the dark luminance be provided so as to be vertically adjacent to each other in the each of the plurality of pixels contained in the unit.

The configuration can prevent occurrence of a flicker due to reversal of brightness and darkness.

It is preferable that the driving means carry out line reversal driving in which the polarities of the voltage to be applied to the each pixel constituting the active matrix liquid crystal display panel are reversed for each operation signal line connected to the each pixel.

According to the configuration, it is unnecessary to increase a spatial polarity reversal period (pitch). Consequently, line reversal driving utilizes an advantage of being carried out at a lower voltage than dot reversal driving. In addition, differently from dot inversion driving, line reversal driving causes no problem of increasing a pitch.

It is preferable that: the each pixel be constituted by a plurality of subpixels; in the active matrix liquid crystal display panel, a scanning signal line be provided for each subpixel arranged in a column; and the driving means carry out line reversal driving in which the polarities of the voltage to be applied to each of the plurality of subpixels constituting the active matrix liquid crystal display panel are reversed for each operation signal line connected to the each of the plurality of subpixels.

According to the configuration, it is possible to reduce a spatial polarity reversal period (pitch) as compared to a case where line reversal driving is carried out for each pixel.

A liquid crystal display device including a liquid crystal driving circuit mentioned above is encompassed in the scope of the present invention.

The embodiments and concrete examples of implementation discussed in the aforementioned detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention is suitably usable as a mobile liquid crystal display device which uses a comparatively small liquid crystal display panel.

REFERENCE SIGNS LIST

10 Liquid crystal display device
11 Liquid crystal display panel
12 Gate driver
13 Source driver
14 Display controller (Driving means)
21 Scanning signal line
22 Data signal line
24 Counter electrode signal line
25 TFT
26 Pixel electrode
31 Positional information detecting section
32 Frame counter
33 Input data converting section
(Brightness or Darkness Determining Means)
34*a* Look-up table
34*b* Look-up table
35 Timing controller
36 Polarity reversal control section
(Polarity Determining Means)

The invention claimed is:

1. A liquid crystal driving circuit which carries out time-division driving with respect to each pixel constituting an active matrix liquid crystal display panel, said liquid crystal driving circuit comprising:

brightness or darkness determining means configured to determine at which of a bright luminance and a dark luminance to drive the each pixel in each frame, the bright luminance being brighter than a specified luminance which corresponds to inputted gray scale data, the dark luminance being darker than the specified luminance;

polarity determining means configured to determine which of a voltage of a positive polarity and a voltage of a negative polarity to apply to liquid crystal of the each pixel in the each frame; and driving means configured to drive the each pixel by causing a bright and dark frame period to be an integral multiple of a positive and negative frame period, the bright and dark frame period being a period of brightness and darkness of luminance at which to drive the each pixel, the positive and negative frame period being a period of polarities of the voltage to be applied to the liquid crystal of the each pixel.

2. The liquid crystal driving circuit as set forth in claim 1, wherein regarding a plurality of pixels as a unit, the driving means drives, in a frame, (i) any of the plurality of pixels of the unit at the bright luminance and (ii) the other pixels of the unit at the dark luminance.

3. The liquid crystal driving circuit as set forth in claim 2, wherein in the driving means, a pixel driven at the bright luminance and a pixel driven at the dark luminance are provided so as to be vertically adjacent to each other in the unit.

4. The liquid crystal driving circuit as set forth in claim 2, wherein:

each of the plurality of pixels contained in the unit is constituted by a plurality of subpixels; and in the driving means, a subpixel driven at the bright luminance and a subpixel driven at the dark luminance are provided so as to be vertically adjacent to each other in the each of the plurality of pixels contained in the unit.

5. The liquid crystal driving circuit as set forth in claim 1, wherein the driving means is configured to carry out line reversal driving in which the polarities of the voltage to be applied to the each pixel constituting the active matrix liquid crystal display panel are reversed for each operation signal line connected to the each pixel.

6. The liquid crystal driving circuit as set forth in claim 1, wherein:

the each pixel is constituted by a plurality of subpixels;

in the active matrix liquid crystal display panel, a scanning signal line is provided for each subpixel arranged in a column; and the driving means is configured to carry out line reversal driving in which the polarities of the voltage to be applied to each of the plurality of subpixels constituting the active matrix liquid crystal display panel are reversed for each operation signal line connected to the each of the plurality of subpixels.

7. A liquid crystal display device including a liquid crystal driving circuit recited in claim 1.

* * * * *